United States Patent [19]

Krause et al.

[11] Patent Number: 4,930,252

[45] Date of Patent: Jun. 5, 1990

[54] CHRISTMAS TREE WATERER

[76] Inventors: Vernon E. Krause, 505 N. 27th; Timothy J. Davis, R.R., both of Norfolk, Nebr. 68701

[21] Appl. No.: 307,919

[22] Filed: Feb. 9, 1989

[51] Int. Cl.[5] ..... A47G 7/02; A01G 31/00

[52] U.S. Cl. ..... 47/40.5; 47/62

[58] Field of Search ..... 47/79, 40.5, 62

[56] References Cited

U.S. PATENT DOCUMENTS

| | | | |
|---|---|---|---|
| 1,453,401 | 5/1923 | Mattson | 47/79 |
| 2,938,304 | 5/1960 | Thomas et al. . | |
| 3,110,287 | 11/1963 | Godshalk . | |
| 3,469,342 | 9/1969 | Morris . | |
| 3,512,712 | 10/1967 | Benesch | 47/79 |
| 3,519,769 | 7/1970 | Grimes . | |
| 3,542,069 | 11/1970 | Ollison | 47/79 |
| 3,697,026 | 10/1972 | Hambrick | 248/524 |
| 4,107,875 | 8/1978 | Bordine | 47/62 |
| 4,653,224 | 3/1987 | Weckesser | 47/40 |
| 4,825,587 | 5/1989 | Stancil | 47/40.5 |

*Primary Examiner*—David A. Scherbel
*Assistant Examiner*—Michele A. Van Patten
*Attorney, Agent, or Firm*—Zarley, McKee, Thomte, Voorhees & Sease

[57] ABSTRACT

An apparatus is provided for supplying water to a conventional tree stand. A water level monitor is selectively positioned within the reservoir of the tree stand and is electrically connected to a solenoid valve so that water will be supplied from a water reservoir to the tree stand when the water level within the tree stand drops to a predetermined level. A float within the monitor drops with the water level, triggering a reed switch and activating the solenoid valve so that water can flow from a reservoir to the tree stand.

7 Claims, 3 Drawing Sheets

CHRISTMAS TREE WATERER

BACKGROUND OF THE INVENTION

This invention relates to an apparatus for maintaining the water level in a Christmas tree stand.

Conventional tree stands normally only contain between two to four quarts of water. A dry tree may require approximately one and a half quarts per day. Thus, the owner must fill the tree stand daily, or at least every two days. Should the tree stand become dry, the tree will dry out which results in needle drop which is not only inconvenient but also poses a fire hazard.

Many different types of tree waterers have been previously provided. For example, in U.S. Pat. No. 2,938,304 issued to Thomas, a water reservoir is suspended within the branches of the tree with the reservoir furnishing water to the tree stand by gravity. In U.S. Pat. No. 3,469,342 which issued to Morris, a container of water is located remote of the tree stand with water being supplied to the tree stand through a pressure head developed within the water reservoir. U.S. Pat. No. 3,697,026 issued to Hambrick discloses a device similar to the Morris invention except that a manually operated water valve is provided between the water reservoir and the tree stand. U.S. Pat. No. 4,653,224 issued to Weckesser discloses a water reservoir located remote of the tree stand and connected thereto by means of a flexible tube. When it is desired to add additional water to the tree stand, the water reservoir is manually raised to cause the flow of water from the reservoir to the tree stand.

It is therefore a principal object of the invention to provide an automatic Christmas tree waterer.

A further object of the invention is to provide an automatic Christmas tree waterer which will supply water to a tree stand without the constant attention of the owner.

Still another object of the invention is to provide a tree waterer including a monitor positioned in the tree stand which will energize a solenoid valve when the water drops to a predetermined level within the tree stand to supply water from a water reservoir to the tree stand.

Yet another object of the invention is to provide an automatic tree waterer which is convenient to use.

Still a further object of the invention is to provide an automatic tree waterer which is aesthetically attractive.

These and other objects will be apparent to those skilled in the art.

SUMMARY OF THE INVENTION

An apparatus is provided for supplying water to a conventional tree stand. In one form of the invention, a water level monitor is selectively positioned within the reservoir of the tree stand and is electrically connected to a solenoid valve so that water will be supplied from a water reservoir to the tree stand when the water level within the tree stand drops to a predetermined level. A float within the monitor drops with the water level, closing a reed switch and activating the solenoid valve so that water can flow from a reservoir to the tree stand. In another embodiment of the invention, a pair of electrodes are selectively positioned within the reservoir of the tree stand and are electrically connected to the solenoid valve with a control circuit so that water will be supplied from the water reservoir to the tree stand when the water within the tree stand drops to a predetermined level. When the circuit between the electrodes senses an absence of water, the solenoid valve is operated for a predetermined length of time so that water can flow from the reservoir to the tree stand.

DESCRIPTION OF THE PREFERRED EMBODIMENT

Figure 1:
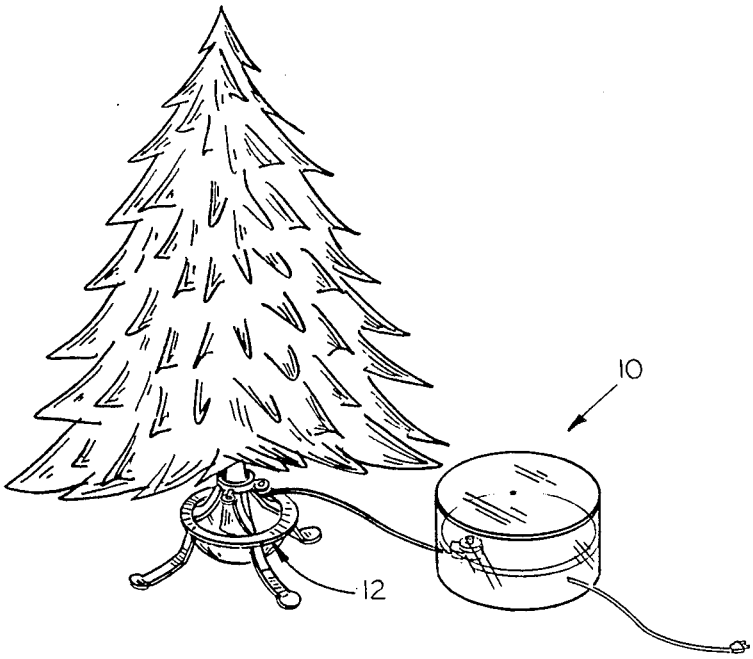
FIG. 1 is a perspective view of the present invention shown installed on a Christmas tree stand.
Figure 2:
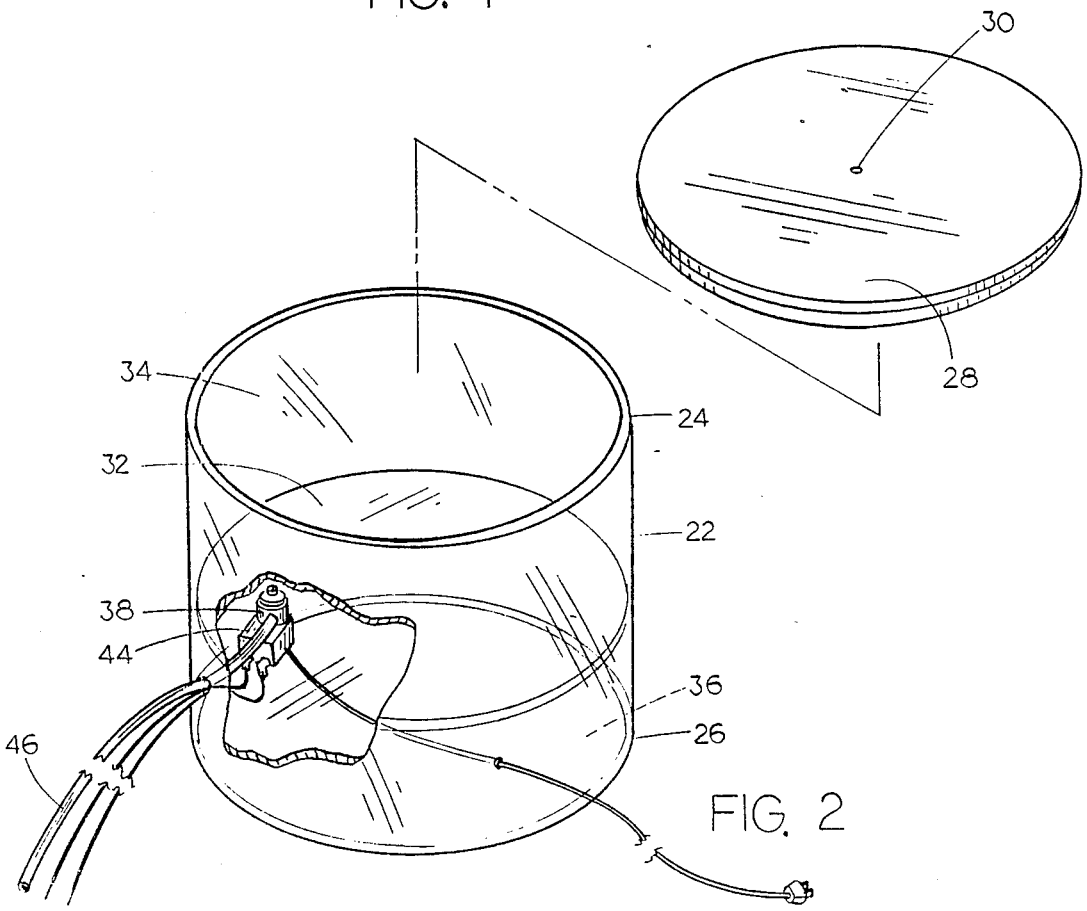
FIG. 2 is an exploded perspective view of the water reservoir portion of the invention.

The tree waterer of this invention, as seen in FIGS. 1–5, is referred to by the reference numeral 10 and is designed to automatically supply water to a Christmas tree stand 12 having a water reservoir 14 defined by bottom 16, side wall 18 and upper edge 20.

Waterer 10 includes upstanding cylindrical member 22 having upper and lower ends 24 and 26 respectively. Upper end 24 is selectively closable by a lid or cover 28 having an opening 30 formed therein. A horizontally disposed plate or wall 32 is provided in member 22 approximately 4 to 6 inches above lower end 26 to define a water compartment or reservoir 34 thereabove and a component compartment 36 therebelow.

Water valve 38 is positioned on the underside of wall 32 and has its inlet opening 40 in communication with opening 42 formed in wall 32 to provide fluid communication between the valve 38 and water reservoir 34. Valve 38 is normally closed and is controlled by a solenoid 44 as will be described in more detail hereinafter.

An elongated flexible tube or hose 46 is connected to the discharge or outlet side of valve 38 and extends to the tree stand 12 as illustrated in the drawings. Preferably, two sections of a Velcro fastener are mounted on the tree stand 12 and are referred to generally by reference numerals **48*a* and 48*b*. The other halves of a Velcro fastener are wrapped around the hose 46 and leads 50 and 52 with the fasteners being referred to by the reference numerals 54*a* and 54*b*. A monitor 56 is provided on the ends of leads 50 and 52 and is positioned within the reservoir 14 of stand 12 as seen in the drawings. The vertical position of the monitor 56 and the end of hose 46 may be selectively varied by simply adjusting fasteners 54*a* and 54*b* with respect to fasteners 48*a* and 48*b***.

Figure 5:
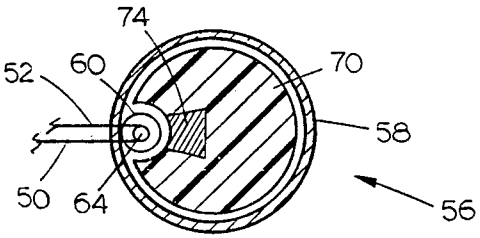
FIG. 5 is a sectional view taken at lines 5—5 in FIG. 4.
Figure 4:
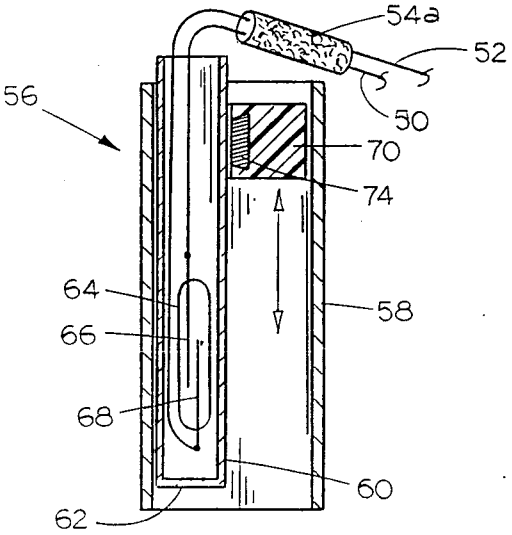
FIG. 4 is a vertical section taken through the monitor of the invention.

Referring now to FIGS. 4 and 5, monitor 56 includes a hollow cylindrical tube 58 having a small conduit 60 affixed along one side of the interior thereof. Conduit 60 has a plug 62 affixed in the lower end thereof so that water will not enter. Leads 50 and 52 extend downwardly within conduit 60 and are connected to opposite ends of a reed switch 64 which is affixed within conduit 60. Reed switch 64 is of a conventional type having a pair of contacts 66 and 68 therein which are normally spaced apart. A generally cylindrical float 70 has a vertical groove 72 cut along one side which closely fits conduit 60, such that conduit 60 will act as a vertical guide for float 70. A small magnet 74 is mounted in float 70 for movement therewith.

Thus, as float 70 moves adjacent reed switch 64, magnet 74 causes contacts 66 and 68 to be magnetically drawn together and close the electrical circuit. As float 70 moves upwardly past the end of reed switch 64, the magnetic field reduces until contacts 66 and 68 separate, thereby opening the electrical circuit.

Figure 3:
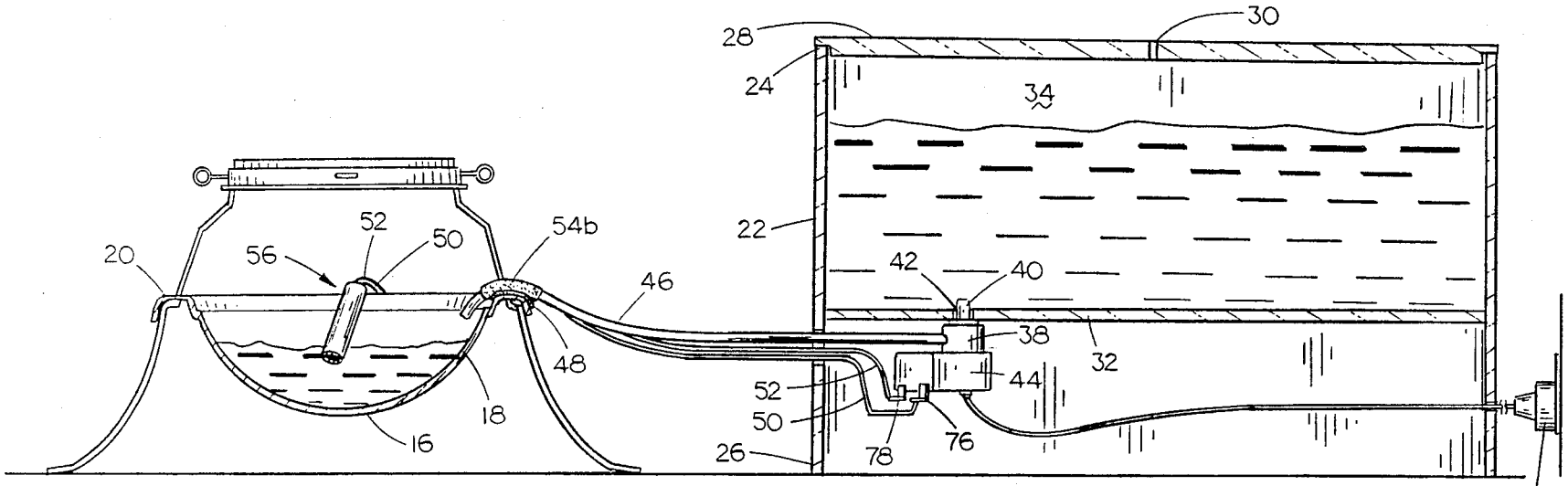
FIG. 3 is a vertical section taken through the watering stand and water reservoir of the invention.

Referring now to FIG. 3, leads 50 and 52 are electrically connected to terminals 76 and 78 on solenoid 44. Power for solenoid 44 is provided by a 6–12 V wall transformer 80. Solenoid 44 is operatively connected to valve 38 for controlling the operation thereof.

In use, the Christmas tree is placed in the stand 12 and secured therein in a conventional fashion. The end of hose 46 and the monitor 56 are positioned within the reservoir through the use of the fasteners 48*a* and 48*b* and 54*a* as previously described. The wall transformer is then plugged into a wall outlet to provide current for solenoid 44 when activated by reed switch 64 (see FIG. 4). When monitor 56 is placed in reservoir 14, float 70 will be raised by the water therein, above reed switch 64, thereby causing reed switch 64 to remain open. When the water in the reservoir drops, float 70 will drop and magnet 74 will cause reed switch 64 to close and activate solenoid 44. Activation of solenoid 44 causes valve 38 to open so that water within the water compartment 34 will flow downwardly through the valve 38 and through the hose 46 into the reservoir 14. Once the water level is raised sufficiently to raise float 70, solenoid 44 is again deactivated so that valve 34 is closed. Water valve 38 will not be opened again until the water once again drops to activate reed switch 64.

Figure 6:
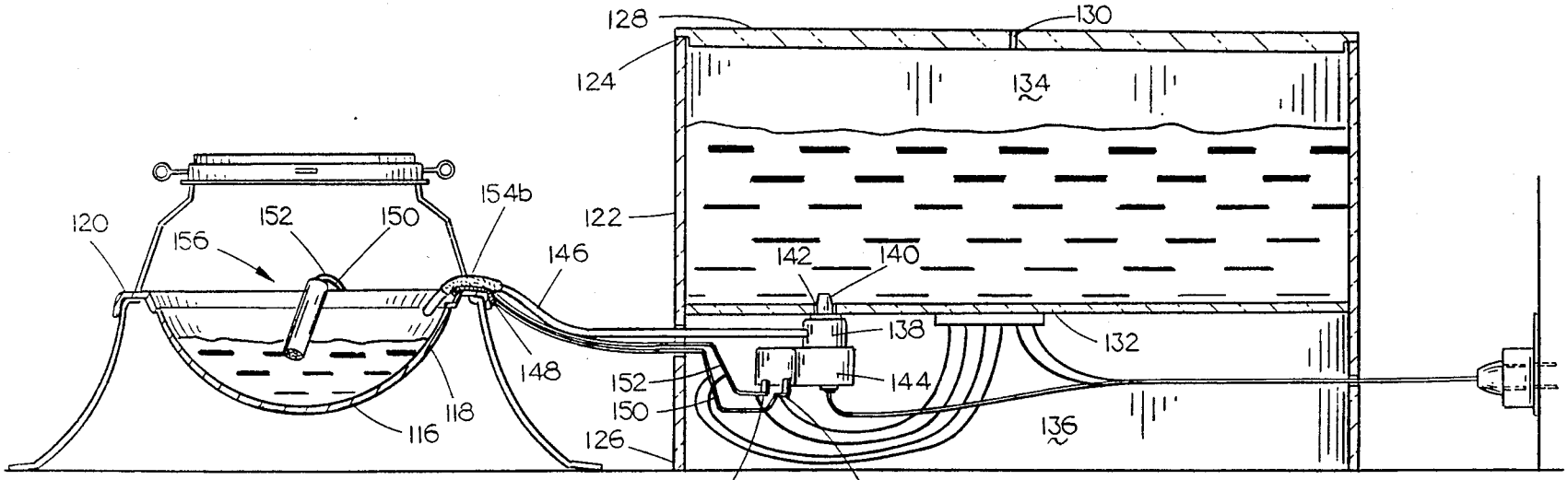
FIG. 6 is a view similar to FIG. 3 except that a modified form of the invention is shown.
Figure 7:
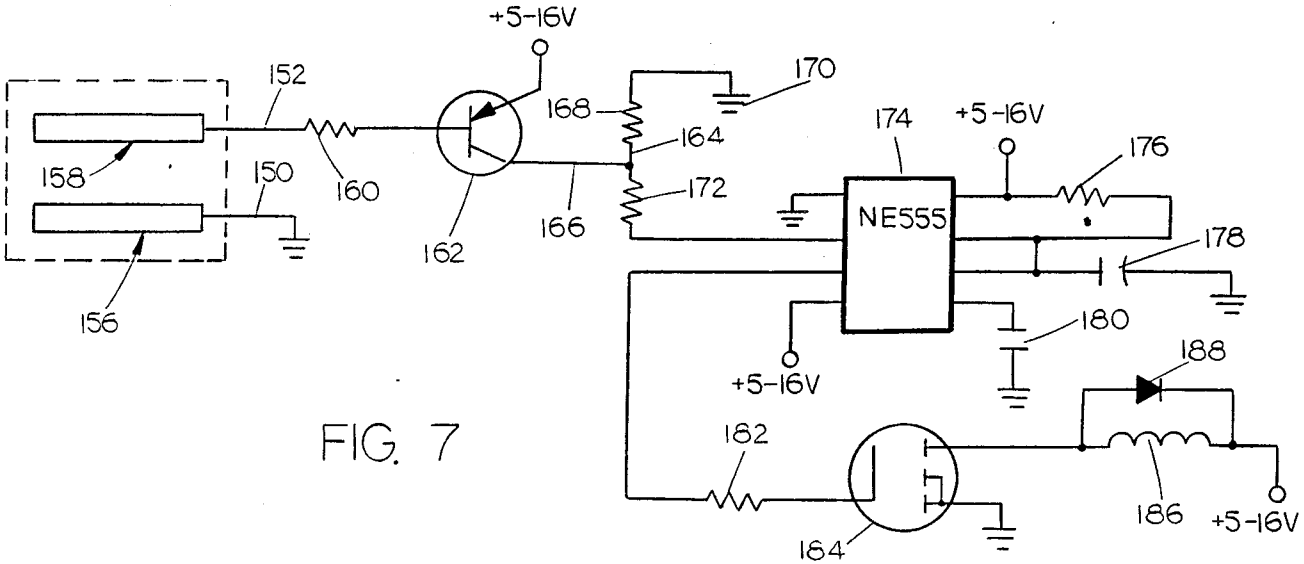
FIG. 7 is a schematic view of the electrical circuitry for the modified form of the invention of FIG. 6.

The modified form of the invention, as illustrated in FIGS. 6 and 7 will now be described.

The embodiment of the invention which is illustrated in FIGS. 6 and 7 is referred to by the reference numeral 110 and is designed to automatically supply water to a Christmas tree stand 112 having a water reservoir 114 defined by bottom 116, side wall 118 and upper edge 120.

Waterer 110 includes upstanding cylindrical member 122 having upper and lower ends 124 and 126 respectively. Upper end 124 is selectively closable by a lid or cover 128 having an opening 130 formed therein. A horizontally disposed plate or wall 132 is provided in member 122 approximately 4 to 6 inches above lower end 126 to define a water compartment or reservoir 134 thereabove and a component compartment 136 therebelow.

Water valve 138 is positioned on the underside of wall 132 and has its inlet opening 140 in communication with opening 142 formed in wall 132 to provide fluid communication between the valve 138 and water reservoir 134. Valve 138 is normally closed and is controlled by a solenoid 144 as will be described in more detail hereinafter.

An elongated flexible tube or hose 146 is connected to the discharge or outlet side of valve 138 and extends to the tree stand 112 as illustrated in the drawings. Preferably, one-half of a Velcro fastener is mounted on the tree stand 112 and is referred to generally by the reference numeral 148. The other half of a Velcro fastener is wrapped around the hose 146 and leads 150 and 152 with the fastener being referred to by the reference numeral 154. Electrodes 156 and 158 are provided on the ends of leads 150 and 152 respectively and are positioned within the reservoir 114 of stand 112 in a spaced-apart relationship as seen in the drawings. The vertical position of the electrodes 156 and 158 and the end of hose 146 may be selectively varied by simply adjusting fastener 154 with respect to fastener 148.

Electrode 156 is grounded as illustrated in FIG. 7, while electrode 158 is connected to resistor 160 by lead 152. Resistor 160 is connected to transistor 162 which is connected to lead 164 by lead 166. When the term "lead" is utilized in this description, it should be understood that the lead could either be of the "hard wire" type or "printed circuit" type. Resistor 168 is imposed in lead 164 and is grounded at 170. Resistor 172 is also imposed in lead 164 as illustrated and is connected to a chip 174. The numerals 176, 178, 180, 182 and 184 refer to a resistor, capacitor, capacitor, resistor and transistor respectively which are included in the circuitry as illustrated in FIG. 7. Transistor 184 is operatively connected to a solenoid 186 and diode 188 as illustrated. Solenoid 186 is operatively connected to the valve 138 for controlling the operation of the same. The entire circuitry is controlled by a 5–16 volt power supply provided by a conventional transformer connected to a source of 110–115 volts A.C. controlled by a switch 190. The solenoid 186 is operated for a predetermined period of time such as 20 seconds, when the circuit between electrodes 156 and 158 is broken, as will be described in more detail hereinafter.

In use, the Christmas tree is placed in stand 112 and secured therein in a conventional fashion. The end of hose 146 and the wires 150 and 152 are placed for position within the reservoir through the use of the fasteners 148 and 154 as previously described. Switch 190 is then actuated and the solenoid 186 will actuate when the circuit between electrodes 156 and 158 is broken. When the electrodes 156 and 158 are immersed in the water in the reservoir 114, control circuitry is inactive. When the water in the reservoir drops to a predetermined level so that a circuit would not completed between the electrodes 156 and 158, solenoid 186 is actuated for 20 seconds or the like so that water within the water compartment 134 will flow downwardly through the valve 138 and through the hose 146 into the reservoir 114. When the predetermined length of time has elapsed, solenoid 186 is deactivated so that valve 138 is closed. Water valve 138 will not be opened again until the water once again drops below the electrodes 156 and 158.

Thus, it can be seen that a novel automatic tree waterer has been provided which will maintain a predetermined level of water within the tree stand for a considerable period of time. The water reservoir 34 may be conveniently refilled without the necessity of reaching beneath the branches of the tree as is the conventional manner. The tree waterer of this invention assures that water will be continuously supplied to the tree stand without the owner being in attendance.

Whereas the invention has been shown and described in connection with the preferred embodiment thereof, it will be understood that many modifications, substitutions and additions may be made which are within the intended broad scope of the appended claims. For example, the AC power converter may be replaced by a battery. This would make the unit stand alone. Likewise, switch 84 may be a toggle switch, pushbutton or any of many convenient varieties.

Thus it can be seen that the invention accomplishes at least all of its stated objectives.

We claim:

1. In combination:

a tree stand having a water reservoir;

an upstanding water supply support means having upper and lower ends;

a water container positioned on the upper end of said support means and having a horizontally disposed bottom wall positioned above the lower end of the support means, and an upstanding side wall means, said bottom wall having an opening formed therein;

a normally closed electrically operated water valve means positioned below said bottom wall and having an inlet side in operative fluid communication with said opening;

a water level monitor positioned within said reservoir;

an electrical control means operatively connected between said water level monitor and said water valve means, for opening said water valve means when the water in said reservoir drops to a first predetermined level;

said electrical control means adapted to open said water valve means when the water in said reservoir drops to a predetermined level and to close said water valve means when the water in said reservoir raises to a second predetermined level.

2. The combination of claim 1 wherein a flexible water tube means extends from the discharge side of said water valve means to said reservoir, to supply water to said reservoir upon activation of said water valve means.

3. The combination of claim 1, wherein said monitor is selectively vertically positioned within said reservoir.

4. The combination of claim 1, wherein the bottom wall of said water container is approximately the same height as the upper end of said tree stand, such that water within said water container will flow by gravity to said tree stand when said water valve is open.

5. The combination of claim 1, wherein said water level monitor is adapted to sense said first predetermined level and said second predetermined level of water in said reservoir.

6. In combination:

a tree stand having a water reservoir;

an upstanding water supply support means having upper and lower ends;

a water container positioned on the upper end of said support means and having a horizontally disposed bottom wall positioned above the lower end of the support means, and an upstanding side wall means, said bottom wall having an opening formed therein;

a normally closed electrically operated water valve means positioned below said bottom wall and having an inlet side in operative fluid communication with said opening;

a water level monitor positioned within said reservoir;

an electrical control means operatively connected between said water level monitor and said water valve means, for opening said water valve means when the water in said reservoir drops to a first predetermined level;

said control means adapted to open said water valve means when the water in said reservoir drops to a predetermined level, and including means for closing said water valve means after a predetermined time period.

7. The combination of claim 6, wherein said predetermined time period is about 20 seconds.

* * * * *